US009826592B2

(12) United States Patent
Tsai et al.

(10) Patent No.: US 9,826,592 B2
(45) Date of Patent: Nov. 21, 2017

(54) LAMP HAVING ILLUMINATION MODULES WITH DIFFERENT PERCENTAGE OF LUMINANCE ADJUSTMENT

(71) Applicants: QISDA (SUZHOU) CO., Ltd., Suzhou, Jiangsu Province (CN); QISDA CORPORATION, Taoyuan (TW)

(72) Inventors: Chang-Yu Tsai, New Taipei (TW); Teng-Yi Tsai, Taoyuan (TW); Jiung-Cheng Pan, Taipei (TW)

(73) Assignees: Qisda (Suzhou) Co., Ltd, Suzhou (CN); Qisda Corporation, Taoyuan County (TW)

( * ) Notice: Subject to any disclaimer, the term of this patent is extended or adjusted under 35 U.S.C. 154(b) by 0 days.

(21) Appl. No.: 15/003,807

(22) Filed: Jan. 22, 2016

(65) Prior Publication Data

US 2016/0323964 A1 Nov. 3, 2016

(30) Foreign Application Priority Data

Apr. 28, 2015 (TW) ..... 104113559 A

(51) Int. Cl.
*F21V 1/00* (2006.01)
*H05B 33/08* (2006.01)

(52) U.S. Cl.
CPC ..... *H05B 33/0872* (2013.01); *H05B 33/0854* (2013.01)

(58) Field of Classification Search
CPC ..... F21Y 2113/005
USPC ..... 362/23.07, 85, 186, 217.04, 249.02
See application file for complete search history.

(56) References Cited

U.S. PATENT DOCUMENTS 7,621,653 B2 * 11/2009 Hendrie ..... F21L 4/027 257/89
8,025,421 B2 * 9/2011 Ku ..... F21K 9/00 362/231
8,138,690 B2 3/2012 Chemel
8,183,785 B2 5/2012 Boleko Ribas
8,690,381 B2 * 4/2014 Yu ..... F21S 4/28 362/219
8,926,128 B2 * 1/2015 Park ..... G02F 1/133615 362/247
2010/0277920 A1 * 11/2010 Choi ..... F21S 8/086 362/249.06

(Continued)

FOREIGN PATENT DOCUMENTS

CN 2864336 Y 1/2007
CN 200986136 Y 12/2007
CN 101684918 A 3/2010

(Continued)

*Primary Examiner* — Thuy Vinh Tran

(57) ABSTRACT

A lamp having a first illumination module, a second illumination module and a control circuit is provided. The first illumination module has a first light-emitting surface, and the second illumination module has a second light-emitting surface connected to the first light-emitting surface. The control circuit is coupled to the first illumination module and the second illumination module. When the control circuit increases the luminance of the first illumination module and the luminance of the second illumination module, a percentage of increasing the luminance of the first illumination module is less than a percentage of increasing the luminance the second illumination module.

19 Claims, 9 Drawing Sheets

(56) References Cited

U.S. PATENT DOCUMENTS

| | | | |
|---|---|---|---|
| 2012/0069563 | A1 | 3/2012 | Klipstein |

FOREIGN PATENT DOCUMENTS

| | | | |
|---|---|---|---|
| CN | 203273701 | U | 11/2013 |
| CN | 203298061 | U | 11/2013 |
| CN | 104154491 | A | 11/2014 |
| TW | M504906 | U | 7/2015 |

* cited by examiner

LAMP HAVING ILLUMINATION MODULES WITH DIFFERENT PERCENTAGE OF LUMINANCE ADJUSTMENT

BACKGROUND OF THE INVENTION

1. Field of the Invention

The present invention relates to a lamp, and more particularly, to a lamp having illumination modules with different percentages of luminance adjustment.

2. Description of the Prior Art

In current working environments, displays are heavily-used and almost replace paper to become the major media for displaying information. A display used in such a working environment is called a visual display terminal (VDT). According ANSI/HFS 100 (American National Standards Institute/Human Factors Society 100), a suggested illumination for a VDT environment is 300 to 500 lux. Please refer to FIG. 1. FIG. 1 illustrates a situation while a prior art lamp 10 is used. When the lamp 10 is used on a desktop 20 and the height H from the desktop 20 to the lamp 10 is 50 centimeters, the illumination of a luminous area 12 is more than 300 lux and meets with the suggested illumination of ANSI/HFS 100 for the VDT environment. The length L1 of the luminous area 12 is about 50 centimeters. However, due to the design of the lamp 10, the illumination outside the luminous area 12 is less than 300 lux, such that the illumination outside the luminous area 12 is not illuminated enough. In this situation, if two or more displays are placed on the desktop 20 or if a user need to write something with hands, the illumination of peripheral area of the desktop 20 would be not enough. Moreover, if the user wants to increase the illumination outside the luminous area 12, one or more lamps are needed to place on the desktop 20. However, the extra lamp on the desktop 20 would reduce the usable space of the desktop 20, and it is more power consumptive than a single lamp.

SUMMARY OF THE INVENTION

An embodiment of the present invention provides a lamp comprising a first illumination module, a second illumination module and a control circuit. The first illumination module has a first light-emitting surface. The second illumination module has a second light-emitting surface connected to the first light-emitting surface. The control circuit is coupled to the first illumination module and the second illumination module. When the control circuit increases the luminance of the first illumination module and the luminance of the second illumination module, a percentage of luminance increasing of the first illumination module is less than a percentage of luminance increasing of the second illumination module.

Another embodiment of the present invention provides a lamp comprising a first illumination module, a second illumination module, a third illumination module and a control circuit. The first illumination module has a first light-emitting surface. The second illumination module has a second light-emitting surface. The third illumination module has a third light-emitting surface. The first light-emitting surface, the second light-emitting surface and the third illumination form a continuous curved surface. The first light-emitting surface is placed between the second light-emitting surface and the third surface. A tangent plane being tangent to an apex of the second light-emitting surface and a tangent plane being tangent to an apex of the first light-emitting surface form a first angle, and a tangent plane being tangent to an apex of the third light-emitting surface and the tangent plane being tangent to the apex of the first light-emitting surface form a second angle. The control circuit is coupled to the first illumination module, the second illumination module and the third illumination module. The control circuit is configured to control the lamp to operate under a normal mode or a scenario mode selectively. When the lamp operates under the normal mode, the first illumination module, the second first illumination module and the third illumination module generate light of a same illumination. When the lamp operates under the scenario mode and the control circuit increases the luminance of the first illumination module, the second first illumination module and the third illumination module, a percentage of increasing luminance of the first illumination module is less than a percentage of increasing luminance of any of the second illumination module and the third illumination module.

These and other objectives of the present invention will no doubt become obvious to those of ordinary skill in the art after reading the following detailed description of the preferred embodiment that is illustrated in the various figures and drawings.

DETAILED DESCRIPTION

Figure 1:
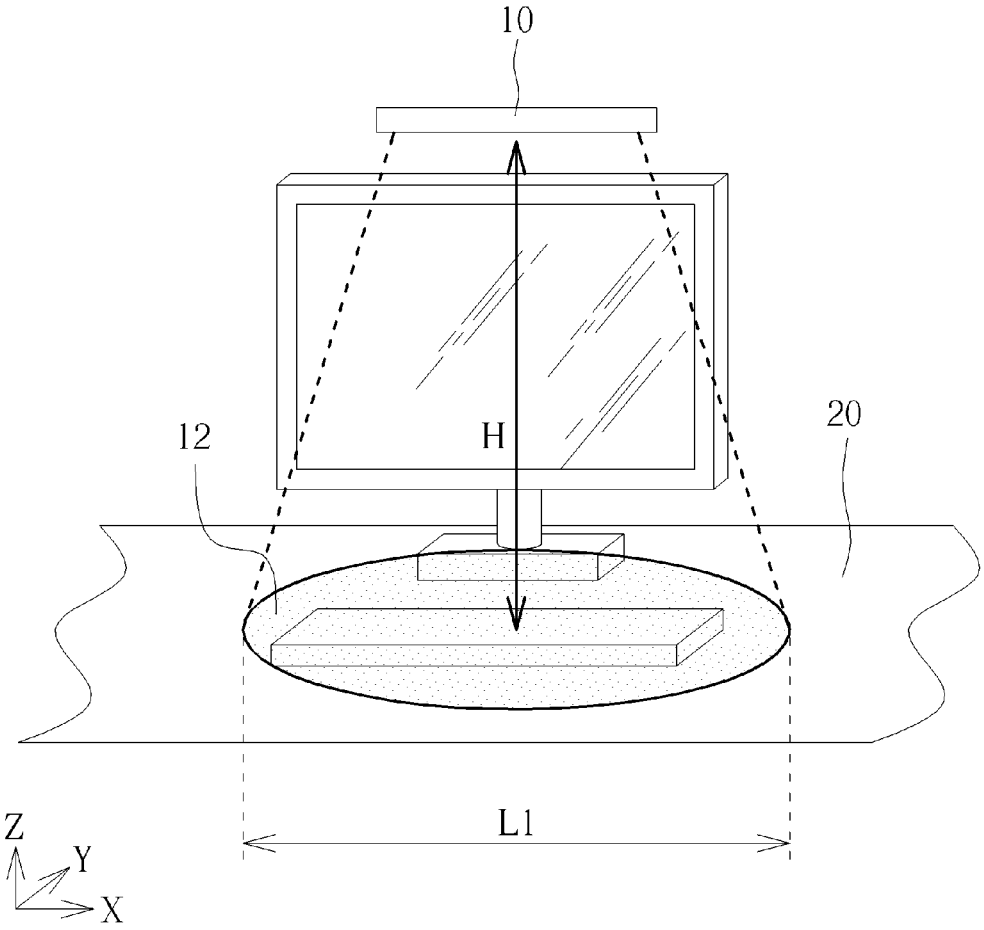
FIG. 1 PRIOR ART
FIG. 1 illustrates a situation while a prior art lamp is used.
Figure 2:
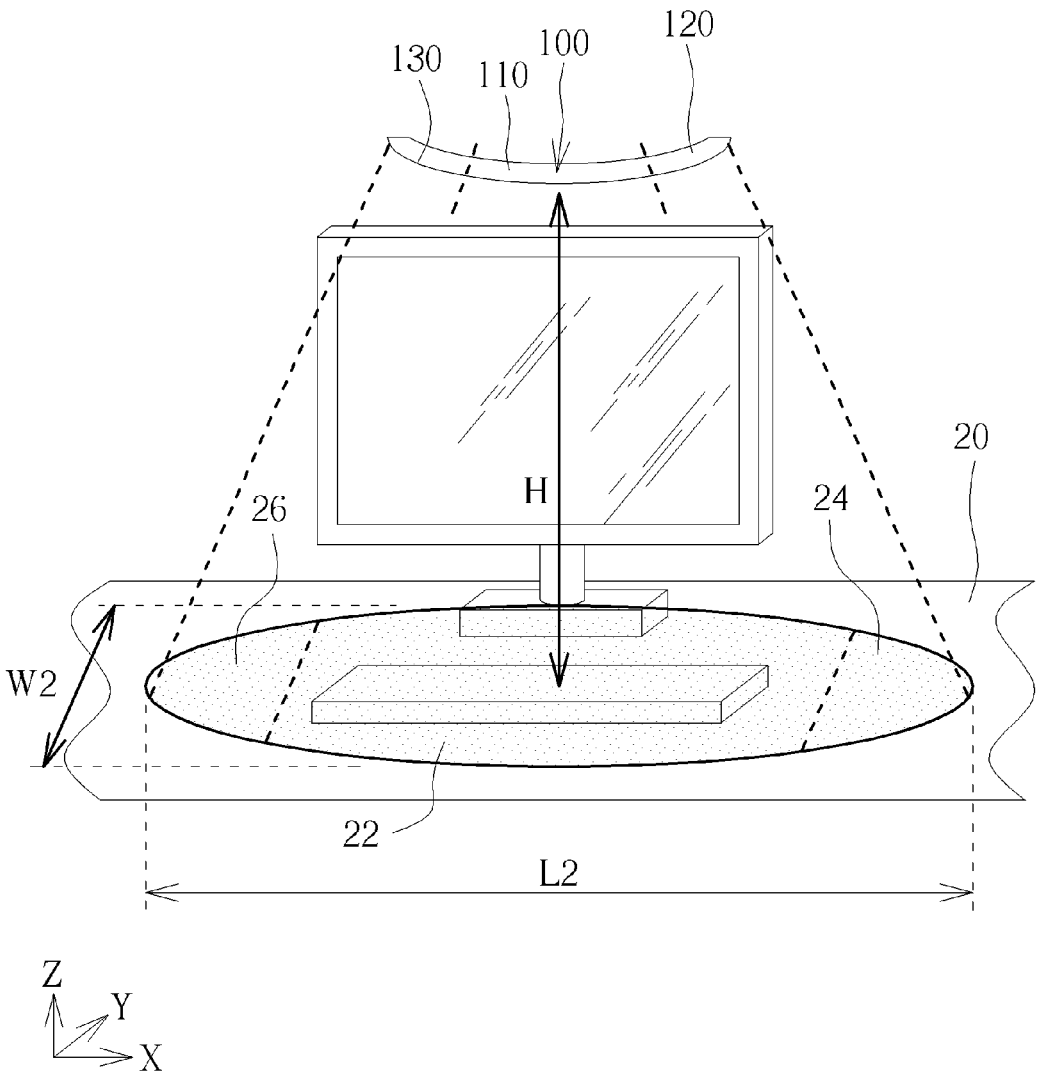
FIG. 2 illustrates a situation while a lamp according to an embodiment of the present invention is used on a desktop.

Please refer to FIG. 2. According to an embodiment of the present invention, FIG. 2 illustrates a lamp 100 is used on a desktop 20, where X, Y and Z present three perpendicular directions respectively. The lamp 100 has a plurality of illumination modules 110, 120 and 130, which are designed according to a concept of the present invention that percentages of luminance adjustment thereof may be different. In detail, the three illumination modules 110, 120 and 130 of the lamp 100 are corresponding to luminous areas 22, 24 and 26 of the desktop 20 respectively, where the illuminance of each of the luminous areas 22, 24 and 26 is above 300 lux. However, the present invention is not limited thereto, and other value of specific illuminance may be used to define the scopes of the luminous areas 22, 24 and 26. If an area of the desktop 20 has illuminance being less than the specific illuminance, the area is not belonged to any of the luminous areas 22, 24 and 26. Because the light emitted from the illumination modules 120 and 130 may compensate the illuminance of the luminous area 22 (i.e. the light emitted from the illumination modules 120 and 130 may increase the illuminance of the luminous area 22), a percentage of luminance increasing of the illumination module 110 may be less than a percentage of luminance increasing of any of the illumination modules 120 and 130 while increasing the illuminance of the desktop 20. The percentage of luminance increasing of any of the illumination modules 110, 120 and 130 may be presented as follow:

$$\text{The percentage of luminance increase}=(B2-B1)/B1\times 100\%$$

Where B1 is the previous luminance of the illumination module before the luminance thereof is increased, and B2 is the subsequent luminance of the illumination module after the luminance thereof is increased. Since the luminance of each of the illumination modules 110, 120 and 130 is positive correlated with the consumed power thereof, a percentage of increase of the consumed power of the illumination module 110 is less than a percentage of increase of the consumed power of any of the illumination modules 120 and 130 while increasing the illuminance of the luminous areas 22, 24 and 26. Therefore, due to the luminance compensation of the illumination modules 120 and 130, the percentage of increase of the consumed power of the illumination module 110 may be discounted while increasing the luminance of the lamp 100. Accordingly, the whole power efficiency of the lamp 100 may be improved, and the lamp 100 is power saving.

Moreover, in the embodiment, if the height H from the desktop 20 to the lamp 10 is 50 centimeters, the total length L2 and the width W2 of the luminous areas 22, 24 and 26 would be 90 centimeters and 50 centimeters respectively. As compared to the lamp 10 that forms the illumination area 12 having a length of 50 centimeters, the lamp 100 is more suitable for an environment (e.g., a multi-display environment) which needs a broad luminous area.

Figure 3:
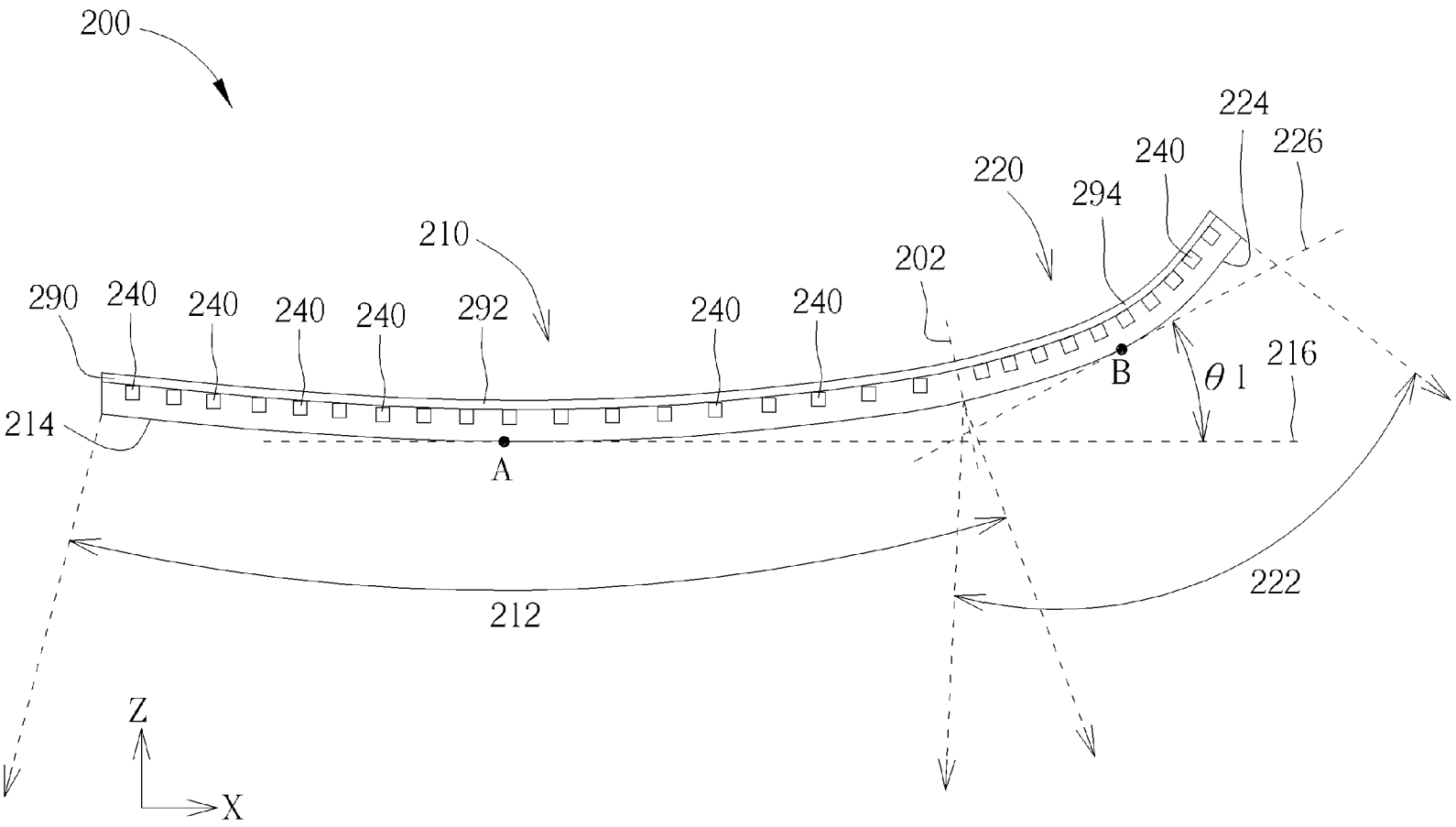
FIG. 3 is a schematic diagram of a lamp according to an embodiment of the present invention.
Figure 4:
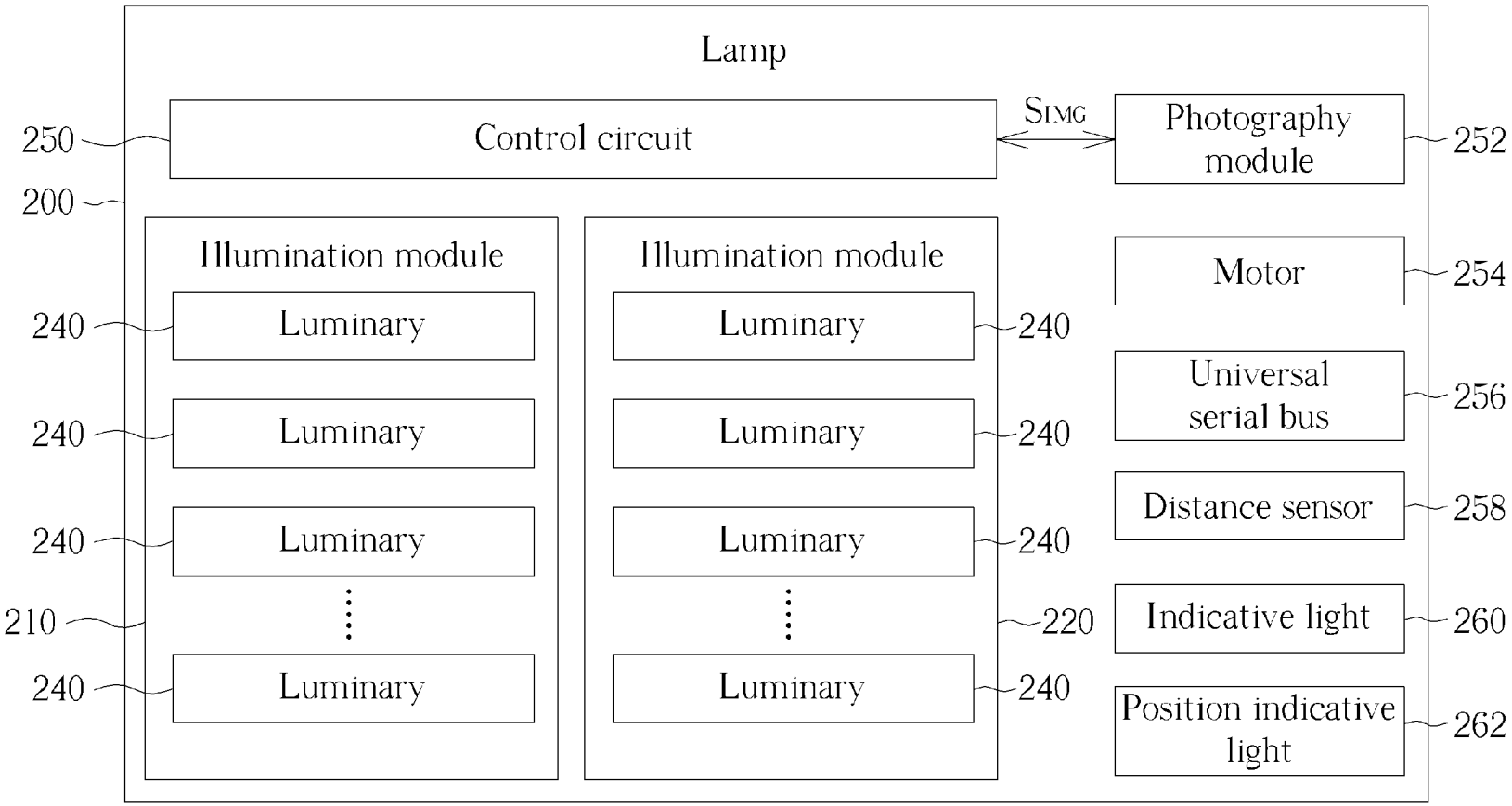
FIG. 4 is a functional diagram of the lamp shown in FIG. 3.

Please refer FIG. 3 and FIG. 4. FIG. 3 is a schematic diagram of a lamp 200 according to an embodiment of the present invention, and FIG. 4 is a functional diagram of the lamp 200 shown in FIG. 3. The lamp 200 has two illumination modules 210 and 220 and a control circuit 250. In the diagram, a dotted line 202 is used to distinguish the two illumination modules 210 and 220. The illumination modules 210 and 220 have light-emitting surfaces 214 and 224 respectively, and the light-emitting surfaces 214 and 224 are connected to form a whole light-emitting surface of the lamp 200. The control circuit 250 is coupled to the illumination modules 210 and 220. In an embodiment of the present invention, when the lamp 200 is used on the desktop 20 shown in FIG. 2, the control circuit 250 sets the illumination module 210 as a first illumination module to correspond to the luminous area 22 and sets the illumination module 220 as a second illumination module to correspond to the luminous area 24. Since the major purpose of the luminous area 22 is used to place information devices, such as display, keyboard, etc., the luminous area 22 may be termed an "information-device-use area". Moreover, since the luminous area 24 is convenient for writing, the luminous area 24 may be termed a "reading-writing area". The light-emitting surface 214 of the illumination module 210 is corresponding to the luminous area 22, and the light-emitting surface 224 of the illumination module 220 is corresponding to the luminous area 24. Because the light emitted from the illumination module 220 may compensate the illuminance of the luminous area 22, a percentage of luminance increasing of the illumination module 210 may be less than a percentage of luminance increasing of the illumination module 220 while increasing the illuminance of the desktop 20. Therefore, due to the luminance compensation of the illumination module 220, the percentage of increase of the consumed power of the illumination module 210 may be discounted while increasing the luminance of the lamp 200. Accordingly, the whole power efficiency of the lamp 200 may be improved, and the lamp 200 is power saving.

In the embodiment, the light-emitting surface 214 and the light-emitting surface 224 are adjacent curved surfaces, and a curvature of the light-emitting surface 224 may be greater than or equal to a curvature of the light-emitting surface 214. In the condition that the curvature of the light-emitting surface 224 is greater than the curvature of the light-emitting surface 214, the area illuminated by the light-emitting surface 224 may be enlarged relatively, such that the corresponding luminous area 24 is enlarged relatively. In more detail, a tangent plane 216 being tangent to an apex A of the light-emitting surface 214 and a tangent plane 226 being tangent to an apex B of the light-emitting surface 224 form an angle θ1 which is between ten degrees to thirty degrees. The greater the angle θ1, the larger the luminous area 24 illuminated by the light-emitting surface 224.

Moreover, in the embodiment, the lamp 200 further comprises a substrate 290. The substrate 290 has a first portion 292 and a second portion which are corresponding to the two light-emitting surfaces 214 and 224 respectively. A plurality of luminaries 240 of the illumination module 210 are disposed on the first portion 292 in a first density, and a plurality of luminaries 240 of the illumination module 220 are disposed on the second portion 294 in a second density. The first density and the second density may be equal or unequal. For example, in an embodiment of the present invention, the first density is less than the second density, and the control circuit 250 provides an identical increasing amount of power to each of luminaries 240 on the substrate 290 when increasing the luminance of the illumination module 210 and the luminance of the illumination module 220. Since increasing amounts of power provided to the luminaries 240 are identical, and the first density is less than the second density, the percentage of luminance increasing of the illumination module 210 is less than the percentage of luminance increasing of the illumination module 220 when the control circuit 250 increases the luminance of the illumination module 210 and the luminance of the illumination module 220. In another embodiment of the present invention, the first density is equal to the second density, and an increasing amount of power provided to each luminary 240 on the first part 292 is less than an increasing amount of power provided to each luminary 240 on the second part 294 when the control circuit 250 increases the luminance of the illumination module 210 and the luminance of the illumination module 220, such that the percentage of luminance increasing of the illumination module 210 is less than the percentage of luminance increasing of the illumination module 220. In an embodiment of the present invention, the luminaries 240 are light emitting diodes (LEDs). However, the present invention is not limited thereto, and the luminaries 240 may be other elements capable of emitting light, e.g., tungsten lamps, vacuum tubes, etc.

In an embodiment of the present invention, the control circuit 250 drives the luminaries 240 of the illumination modules 210 and 220 with AC currents. In another embodiment of the present invention, the control circuit 250 drives the luminaries 240 of the illumination modules 210 and 220 with DC currents, and the control circuit 250 adjusts the luminance of the illumination module 210 by changing the DC currents flowing through the luminaries 240 of the illumination module 210 and adjusts the luminance of the illumination module 220 by changing the DC currents flowing through the luminaries 240 of the illumination module 220. When the luminaries 240 of the illumination modules 210 and 220 are driven by DC currents, flicker of the illumination modules 210 and 220 would be avoided, such that user's tired eyes due to the flicker and long use time of the lamp would be avoided.

In an embodiment of the present invention, the lamp 200 may further comprises a photography module 252 which is configured to photograph the desktop 20 to get an image $S_{IMG}$ so that the control circuit 250 may determine the foresaid information-device-use area according to the image $S_{IMG}$. For example, the control circuit 250 may have a function for image analyzing, such that the control circuit 250 may determine whether any specific object (e.g., a display or a keyboard) exists within the field of view of the photography module 252 by analyzing the image $S_{IMG}$. When the control circuit 250 determines that the specific object exists within the field of view of the photography module 252, the control circuit 250 may determine that the light-emitting surface 214 of the lamp 200 has been placed at a correct position for correctly illuminating the luminous area 22. In addition, the lamp 200 may further comprise a motor 254 coupled to the illumination module 210 and configured to rotate the illumination module 210. When the control circuit 250 determines that the light-emitting surface 214 of the lamp 200 has not been placed at the correct position according to the image $S_{IMG}$, the control circuit 250 may control the motor 254 to drive the illumination module 210 to a proper position or angle, such that the illumination module 210 may correspond to the luminous area 22 and illuminate the luminous area 22 correctly.

Moreover, in another embodiment of the present invention, the control circuit 250 may dynamically adjust the luminous areas corresponding to the light-emitting surfaces 214 and 224 according to the image $S_{IMG}$. For example, when the lamp 200 is placed at the upper left of the desktop 20, and the light-emitting surfaces 214 and 224 are respectively corresponding to the luminous areas 26 and 22, the control circuit 250 may determine such situation according to the image $S_{IMG}$. Accordingly, the control circuit 250 sets the illumination modules 210 and 220 as "a second illumination module" and "a first illumination module" respectively, sets the light-emitting surfaces 214 and 224 as "a second light-emitting surface" and "a first light-emitting surface" respectively, and controls the percentage of luminance increasing of the illumination module 220 is less than the percentage of luminance increasing of the illumination module 210 when increasing the luminance of the illumination module 210 and the luminance of the illumination module 220. For another example, when the lamp 200 is placed directly above the desktop 20, and the light-emitting surfaces 214 and 224 are respectively corresponding to the luminous areas 22 and 24, the control circuit 250 may determine such situation according to the image $S_{IMG}$. Accordingly, the control circuit 250 sets the illumination modules 210 and 220 as "a first illumination module" and "a second illumination module" respectively, sets the light-emitting surfaces 214 and 224 as "a first light-emitting surface" and "a second light-emitting surface" respectively, and controls the percentage of luminance increasing of the illumination module 210 is less than the percentage of luminance increasing of the illumination module 220 when increasing the luminance of the illumination module 210 and the luminance of the illumination module 220. Therefore, in a condition that the lamp 200 would not be moved by the user, the control 250 may dynamically adjust the luminous areas corresponding to the light-emitting surfaces 214 and 224 according to the position of the lamp 200 on the desktop 20, and may dynamically adjust the manner for changing the luminance of the illumination modules 210 and 220. Since the lamp 200 is adjusted dynamically based on the position thereof, the lamp 200 is friendly in use.

In an embodiment of the present invention, the lamp 200 may further comprise a distance sensor 258 and an indicative light 260. The distance sensor 258 and the indicative light 260 are coupled to the control circuit 250. The distance sensor 258 is configured to sense a distance between an object (e.g., the desktop 20) and the illumination module 210 when the lamp 200 illuminates the surface of the object. When the distance between the object and the illumination module 210 is in a specific range (e.g., thirty centimeters to sixty centimeters), the control circuit 250 controls the indicative light 260 to emit light. When the distance between the object and the illumination module 210 is out of the specific range, the control circuit 250 controls the indicative light 260 to stop emitting. According to the on/off status of the indicative light 260, a user may be notified whether the distance between lamp 200 and the desktop 20 is proper.

In an embodiment of the present invention, the lamp 200 may further comprise a position indicative light 262 which is configured to project a point of light in a direction being perpendicular to the tangent plane 216 being tangent to the apex A of the light-emitting surface 214. Accordingly, a user may determine whether the light-emitting surface 214 is properly corresponding to the luminous area 22 according to the point of light.

In an embodiment of the present invention, the lamp 200 may selectively operates under a normal mode or a scenario mode. It is supposed that the light-emitting surfaces 214 and 224 are respectively corresponding to the luminous areas 22 and 24. When the lamp 200 operates under the normal mode, the luminous areas 22 and 24 are of the same illuminance. When the lamp 200 operates under the scenario mode, the percentage of increasing luminance of the illumination module 210 is less than the percentage of increasing luminance the illumination module 220. Therefore, by switching the lamp 200 between the normal mode and the scenario mode, a user may use the lamp 200 more flexible to fit various illumination requirements in different environments. In an embodiment of the present invention, the lamp 200 may further comprise a universal serial bus (USB) interface 256 which is configured to be coupled to an exterior information device (e.g., a personal computer), such that the exterior information device may provide electrical power to the lamp 200 via the USB interface 256. Moreover, the information device may provide an instruction to command the lamp 200 to operate under the normal mode or the scenario mode.

It should be noted that, the foresaid photography module 252, the motor 254, the USB interface 256, the distance sensor 258, the indicative light 260 and the position indicative light 262 are selective elements for the lamp of the present invention. In other words, these elements are not necessary components of the lamp.

Figure 5:
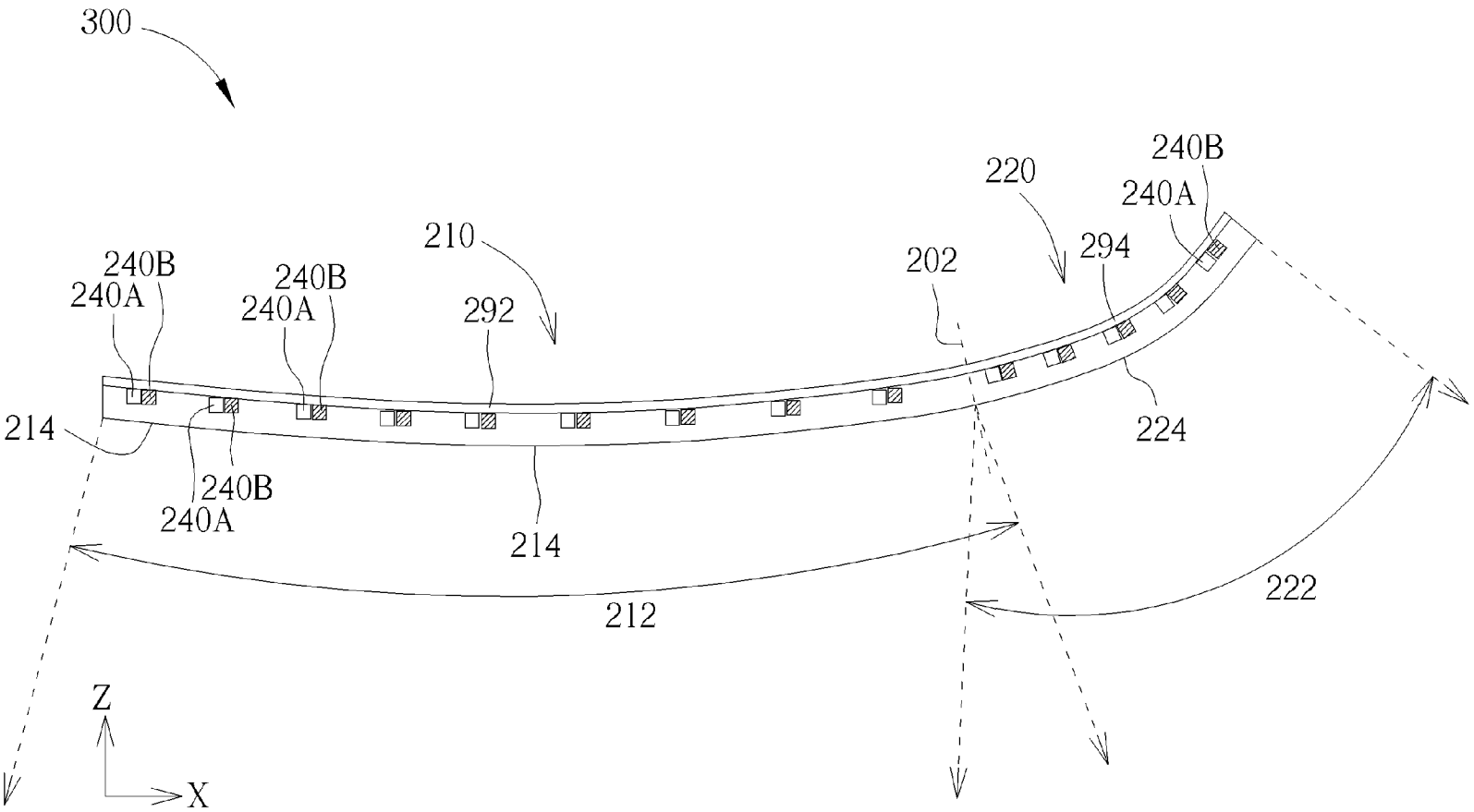
FIG. 5 is a schematic diagram of a lamp according to an embodiment of the present invention.

In an embodiment of the present invention, the lamp has a function for adjusting a color temperature thereof. Please refer to FIG. 5. FIG. 5 is a schematic diagram of a lamp 300 according to an embodiment of the present invention. The major difference between the lamps 200 and 300 is that the luminaries 240 of the lamp 200 are replaced by the luminaries 240A and 240B of the lamp 300. The color of light emitted from the luminaries 240A is different from the color of light emitted from the luminaries 240B. The control circuit 250 may adjust the color temperature of the illumination module 210 by controlling currents of the luminaries 240A and the luminaries 240B of the illumination module 210, and may adjust the color temperature of the illumination module 220 by controlling currents of the luminaries 240A and the luminaries 240B of the illumination module 220. In the embodiment, the luminaries 240A are first color light-emitting diodes, the luminaries 240B are second color light-emitting diodes, and the color of light emitted from the luminaries 240A is different from the color of light emitted from the luminaries 240B. However, the present invention is not limited thereto, and the luminaries 240A and 240B may be other elements capable of emitting light, e.g., tungsten lamps, vacuum tubes, etc.

Figure 6:
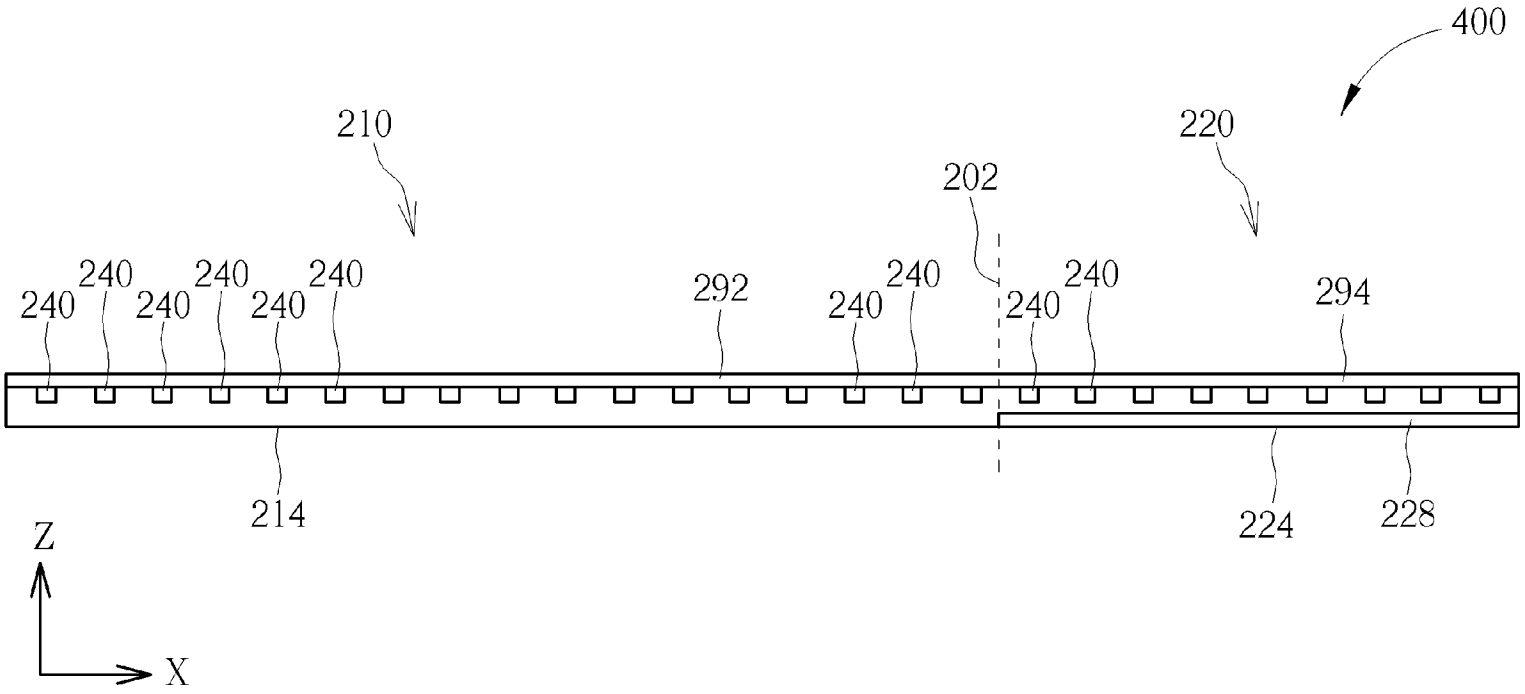
FIG. 6 is a schematic diagram of a lamp according to an embodiment of the present invention.
Figure 7:
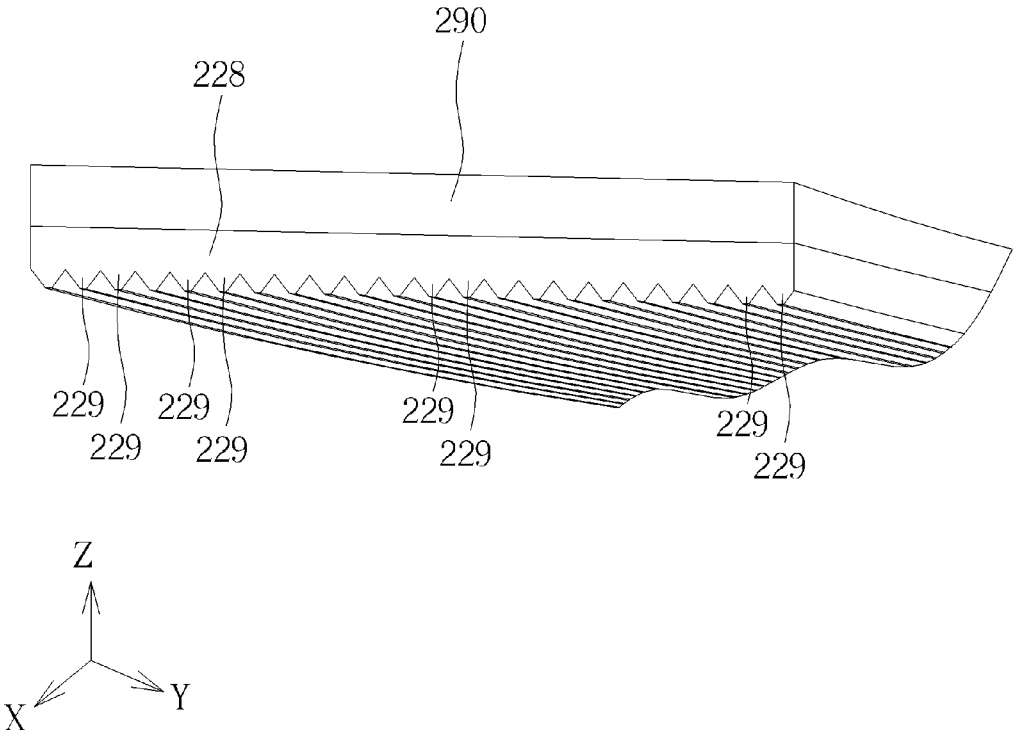
FIG. 7 is a schematic diagram of a luminance enhancement structure of a lamp according to an embodiment of the present invention.

In an embodiment of the present invention, the light-emitting surfaces 210 and 220 are of a same flat surface. Please refer to FIG. 6. FIG. 6 is a schematic diagram of a lamp 400 according to an embodiment of the present invention. The major difference between the lamps 200 and 300 is that the substrate 290 of the lamp 400 is a flat plate and that the illumination module 220 of the lamp 400 further comprises a luminance enhancement structure 228. The luminance enhancement structure 228 is used to concentrate the light emitted from the luminaries 240 of the illumination module 220, and may be made of a transparent material. As shown in FIG. 7, in an embodiment of the present invention, the luminance enhancement structure 228 may comprise strips of protuberances 229 configured to concentrate the light emitted from the luminaries 240. When the control circuit 250 increases the luminance of the illumination module 210 and the luminance of the illumination module 220, the percentage of luminance increasing of the illumination module 210 is less than the percentage of luminance increasing of the illumination module 220. In addition, the strips of protuberances 229 of the luminance enhancement structure 228 may be replaced by other optical elements, which include but are not limited to micro lenses, soft-focus attachments, etc.

Figure 8:
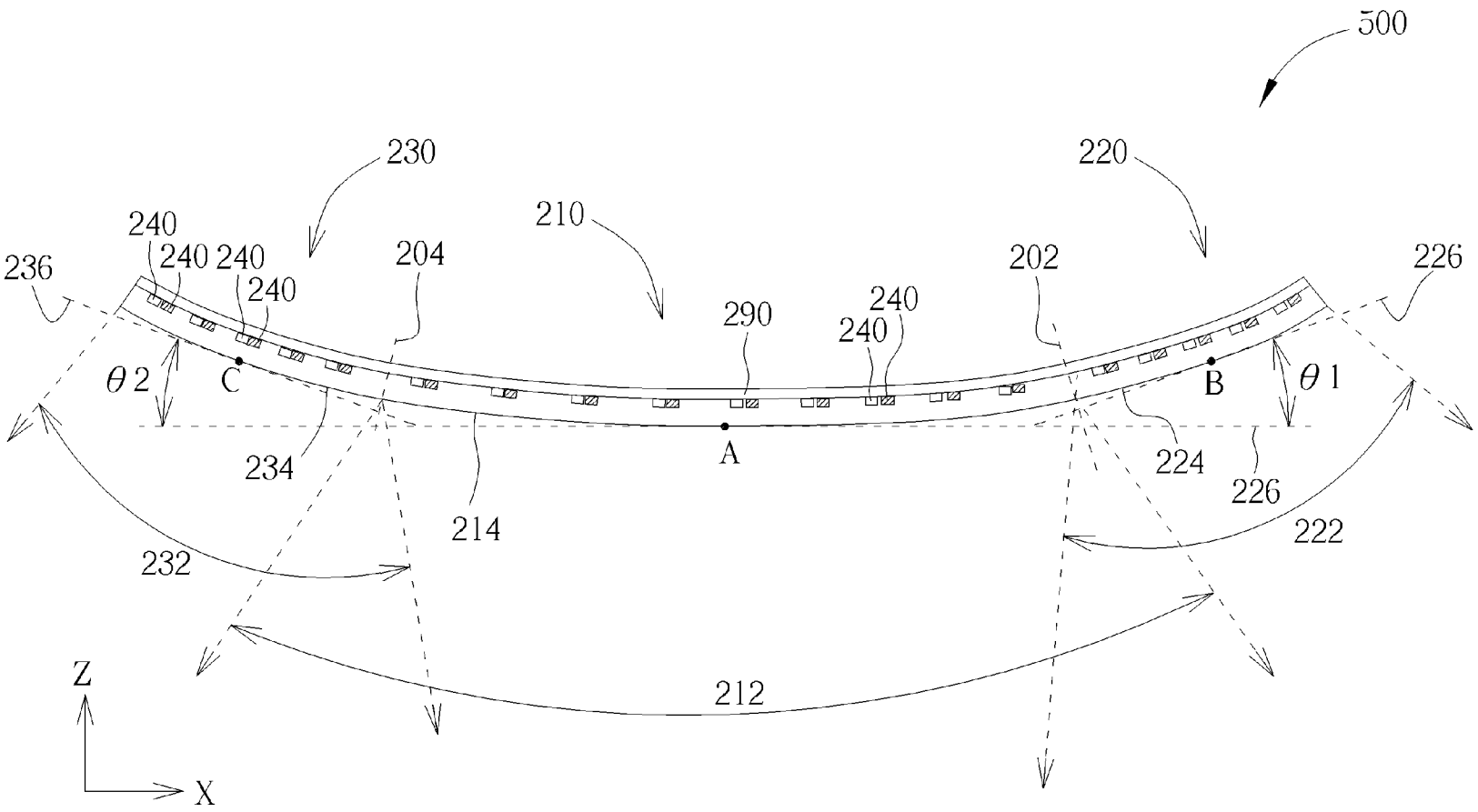
FIG. 8 is a schematic diagram of a lamp according to an embodiment of the present invention.

Please refer FIG. 8. FIG. 8 is a schematic diagram of a lamp 500 according to an embodiment of the present invention. Different from the lamps, each of which has two illumination modules 210 and 220, in the previous embodiments, the lamp 500 has three illumination modules 210, 220 and 230. Two dotted lines 202 and 240 are used to distinguish the three illumination modules 210, 220 and 230. The illumination modules 210, 220 and 230 have light-emitting surfaces 214, 224 and 234 respectively. The light-emitting surfaces 214, 224 and 234 are connected to form a whole light-emitting surface of the lamp 500, and the light-emitting surfaces 214, 224 and 234 are corresponding to the luminous areas 22, 24 and 26 respectively. The light-emitting surface 214 is located between the light-emitting surfaces 214 and 234. The tangent plane 216 being tangent to the apex A of the light-emitting surface 214 and the tangent plane 226 being tangent to the apex B of the light-emitting surface 224 form the angle θ1, and the tangent plane 226 being tangent to the apex B of the light-emitting surface 224 and the tangent plane 236 being tangent to the apex C of the light-emitting surface 234 form an angle θ2. The angles θ1 and θ2 may be equal or unequal, and angles θ1 and θ2 may be between ten degrees to thirty degrees. The greater the angle θ1, the greater an illumination range 222 of the light-emitting surface 224 and the larger the luminous area 24 illuminated by the light-emitting surface 224. Similarly, the greater the angle θ2, the greater an illumination range 232 of the light-emitting surface 234 and the larger the luminous area 26 illuminated by the light-emitting surface 234. The lamp 500 also comprises the control circuit 250. The control circuit 250 controls the lamp 200 to selectively operate under a normal mode or a scenario mode. When the lamp 500 operates under the normal mode, the luminance of the illumination modules 210, 220 and 230 are the same. When the lamp 500 operates under the scenario mode and the control circuit 250 increases the luminance of the illumination modules 210, 220 and 230, a percentage of increasing luminance of the illumination module 210 is less than a percentage of increasing luminance of any of the illumination modules 220 and 230. Since the illumination modules 220 and 230 are positioned at different sides of the illumination module 210, the lamp 500 provide a broader luminous area than the lamp 200.

In an embodiment of the present invention, the lamp 500 may further comprise the photography module 252, the motor 254, the USB interface 256, the distance sensor 258, the indicative light 260 and/or the position indicative light 262 of the lamp 200. Since the functions thereof have been explained previously, they would not be repeated herein.

Figure 9:
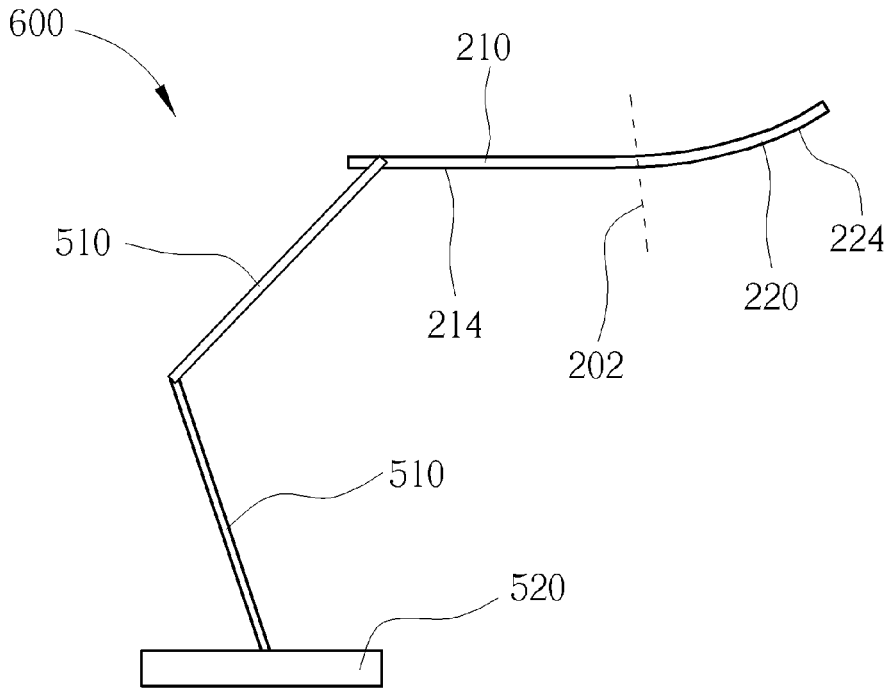
FIG. 9 is a schematic diagram of a lamp according to an embodiment of the present invention.
Figure 10:
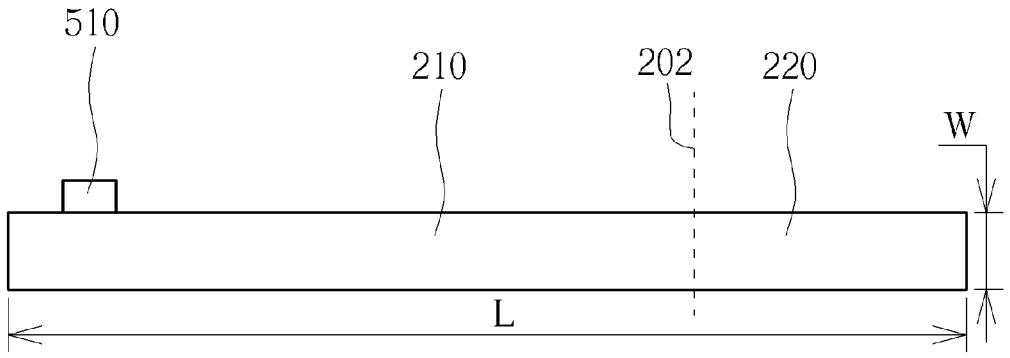
FIG. 10 is a plan view of the illumination modules and a support of the lamp shown in FIG. 9.

Please refer to FIG. 9 and FIG. 10. FIG. 9 is a schematic diagram of a lamp 600 according to an embodiment of the present invention, and FIG. 10 is a plan view of the illumination modules 210 and 220 and a support 510 of the lamp 600. The lamp 600 comprises the illumination modules 210 and 220, the support 510 and a support 520. The illumination module 210 connects to the support 510. The length L of the substrate 290 of the lamp 290 is between thirty centimeters to fifty centimeters, and the width W of the substrate 290 is between five centimeters to fifteen centimeters. The length of the light-emitting surface 214 of the illumination module 210 is greater than the length of the light-emitting surface 224 of the illumination module 220.

According to the foresaid embodiments of the present invention, due to the luminance compensation of peripheral illumination module (s), the percentage of increase of the consumed power of another illumination module may be discounted while increasing the luminance of the lamp. Accordingly, the whole power efficiency of the lamp may be improved, and the lamp is power saving. In an embodiment of the present invention, the lamp has a function for adjusting a color temperature thereof. A user may adjust the color temperature of the lamp based on different illumination requirements or environments. Thus the lamp is flexible in use. In other embodiments of the present invention, the lamp may further comprise a position indicative light, a distance sensor or a photography module to help the user to place the lamp in a proper position. Further, in an embodiment of the present invention, the light-emitting surfaces of the illumination modules may not of a same flat surface, such that the lamp has a broad luminous area to fit the illumination requirements in a multi-display environment or a multi-purpose environment.

Those skilled in the art will readily observe that numerous modifications and alterations of the device and method may be made while retaining the teachings of the invention. Accordingly, the above disclosure should be construed as limited only by the metes and bounds of the appended claims.

What is claimed is:

1. A lamp comprising:

a first illumination module comprising a first light-emitting surface;

a second illumination module comprising a second light-emitting surface connected to the first light-emitting surface; and a control circuit coupled to the first illumination module and the second illumination module;

wherein a percentage of luminance increasing of the first illumination module is less than a percentage of luminance increasing of the second illumination module when the control circuit increases the luminance of the first illumination module and the luminance of the second illumination module; and wherein the lamp is used on a desktop comprising an information-device-use area corresponding to the first light-emitting surface and a reading-writing area corresponding to the second light-emitting surface.

2. The lamp of claim 1, wherein the first light-emitting surface and the second light-emitting surface are of a same flat surface, and the second light-emitting surface comprises a luminance enhancement structure.

3. The lamp of claim 1, wherein the first light-emitting surface and the second light-emitting surface are adjacent curved surfaces, and a curvature of the second light-emitting surface is greater than a curvature of the first light-emitting surface.

4. The lamp of claim 1, wherein a length of the first light-emitting surface is greater than a length of the second light-emitting surface.

5. The lamp of claim 1, further comprising:

a substrate comprising:

a first portion corresponding to the first light-emitting surface; and a second portion corresponding to the second light-emitting surface;

wherein a plurality of luminaries of the first illumination module are disposed on the first portion in a first density, and a plurality of luminaries of the second illumination module are disposed on the second portion in a second density.

6. The lamp of claim 5, wherein the first density is less than the second density, and an identical increasing amount of power is provided to each of luminaries on the substrate when increasing the luminance of the first illumination module and the luminance of the second illumination module.

7. The lamp of claim 5, wherein the first density is equal to the second density, and an increasing amount of power provided to each luminary on the first portion is less than an increasing amount of power provided to each luminary on the second portion when increasing the luminance of the first illumination module and the luminance of the second illumination module.

8. The lamp of claim 5, wherein length of the substrate is between thirty centimeters to fifty centimeters, and width of the substrate is between five centimeters to fifteen centimeters.

9. The lamp of claim 5, wherein the substrate is an arcuate structure, and a tangent plane being tangent to an apex of the first light-emitting surface and a tangent plane being tangent to an apex of the second light-emitting surface form a first angle being between ten degrees to thirty degrees.

10. The lamp of claim 5, wherein the plurality of luminaries of the first illumination module comprises a plurality of first color light-emitting diodes and a plurality of second color light-emitting diodes;

the plurality of luminaries of the second illumination module comprises a plurality of first color light-emitting diodes and a plurality of second color light-emitting diodes;

the control circuit adjusts a color temperature of the first illumination module by controlling currents of the plurality of first color light-emitting diodes and the plurality of second color light-emitting diodes of the first illumination module; and the control circuit adjusts a color temperature of the second illumination module by controlling currents of the plurality of first color light-emitting diodes and the plurality of second color light-emitting diodes of the second illumination module.

11. The lamp of claim 1, further comprising a photography module configured to photograph the desktop to get an image so that the control circuit determines the information-device-use area according to the image.

12. The lamp of claim 11, further comprising a motor coupled to the first illumination module and configured to drive the first illumination module to correspond to the information-device-use area.

13. The lamp of claim 11, wherein the control circuit determines positions of the first light-emitting surface and the second light-emitting surface according to the image, such that the first light-emitting surface is corresponding to the information-device-use area and the second light-emitting surface is corresponding to the reading-writing area.

14. The lamp of claim 1, wherein the lamp operates under a normal mode or a scenario mode selectively;

the information-device-use area and the reading-writing area are of a same illuminance when the lamp operates under the normal mode; and the percentage of increasing luminance of the first illumination module is less than the percentage of increasing luminance the second illumination module when the lamp operates under the scenario mode.

15. The lamp of claim 14, further comprising a universal serial bus (USB) interface configured to be coupled to an information device for providing electrical power to the lamp, wherein the information device provides an instruction to command the lamp to operate under the normal mode or the scenario mode.

16. The lamp of claim 1, further comprising:

a distance sensor coupled to the control circuit, configured to sense a distance between an object and the first illumination module when the lamp illuminates a surface of the object; and an indicative light coupled to the control circuit;

wherein when the distance between the object and the first illumination module is in a specific range, the control circuit controls the indicative light to emit light;

wherein when the distance between the object and the first illumination module is out of the specific range, the control circuit controls the indicative light to stop emitting.

17. The lamp of claim 1, further comprising a position indicative light configured to project a point of light in a direction being perpendicular to a tangent plane being tangent to an apex of the first light-emitting surface.

18. A lamp comprising:

a first illumination module comprising a first light-emitting surface;

a second illumination module comprising a second light-emitting surface;

a third illumination module comprising a third light-emitting surface, wherein the first light-emitting surface, the second light-emitting surface and the third light-emitting surface form a continuous curved surface, the first light-emitting surface is placed between the second light-emitting surface and the third light-emitting surface, a tangent plane being tangent to an apex of the second light-emitting surface and a tangent plane being tangent to an apex of the first light-emitting surface form a first angle, and a tangent plane being tangent to an apex of the third light-emitting surface and the tangent plane being tangent to the apex of the first light-emitting surface form a second angle; and a control circuit coupled to the first illumination module, the second illumination module and the third illumination module, configured to control the lamp to operate under a normal mode or a scenario mode selectively;

wherein when the lamp operates under the normal mode, the first illumination module, the second first illumination module and the third illumination module generate light of a same luminance; and wherein when the lamp operates under the scenario mode and the control circuit increases the luminance of the first illumination module, the second first illumination module and the third illumination module, a percentage of increasing luminance of the first illumination module is less than a percentage of increasing luminance of any of the second illumination module and the third illumination module.

19. A lamp used on a desktop comprising an information-device-use area and two reading-writing areas, the lamp comprising:

a first illumination module comprising a first light-emitting surface corresponding to the information-device-use area;

a second illumination module comprising a second light-emitting surface corresponding to one of the reading-writing areas;

a third illumination module comprising a third light-emitting surface corresponding to the other one of the reading-writing areas, wherein the first light-emitting surface, the second light-emitting surface and the third light-emitting surface form a continuous curved surface, and the first light-emitting surface is placed between the second light-emitting surface and the third light-emitting surface; and a control circuit coupled to the first illumination module, the second illumination module and the third illumination module, configured to control the lamp to operate under a normal mode or a scenario mode selectively, wherein when the lamp operates under the normal mode, the information-device-use area and the reading-writing areas are of a same illuminance, wherein when the lamp operates under the scenario mode, a percentage of increasing luminance of the first illumination module is different to percentages of increasing luminance of the second illumination module and the third illumination module.

* * * * *